US006342456B1

(12) United States Patent
Jenkins et al.

(10) Patent No.: US 6,342,456 B1
(45) Date of Patent: Jan. 29, 2002

(54) POLYPROPYLENE OUTDOOR FABRIC

(75) Inventors: Laurie A. Jenkins; Albert J. Weil, both of Greensboro, NC (US); J. Thomas Hood, Pawleys Island, SC (US); Dermot F. O'Hare, Jonesborough, TN (US); Clyde N. Rhem, II; Robert F. Tucker, both of Johnson City, TN (US); Troy D. Ohmes, Kernersville, NC (US); Paul D. Barbour, Gretna, VA (US)

(73) Assignee: Burlington Industries, Inc., Greensboro, NC (US)

( * ) Notice: Subject to any disclaimer, the term of this patent is extended or adjusted under 35 U.S.C. 154(b) by 0 days.

(21) Appl. No.: 09/241,098

(22) Filed: Feb. 1, 1999

(51) Int. Cl.[7] ..... D03D 15/00; B32B 5/08; B32B 27/02

(52) U.S. Cl. ..... 442/208; 442/220; 139/383 R; 139/420 A

(58) Field of Search ..... 442/208, 220; 139/383 R, 420 A

(56) References Cited

U.S. PATENT DOCUMENTS

| | | | | |
|---|---|---|---|---|
| 4,914,772 A | | 4/1990 | Difloe | 5/652.1 |
| 5,005,241 A | | 4/1991 | Difloe | 5/652.1 |
| 5,093,946 A | | 3/1992 | Difloe | 5/652.1 |
| 5,189,743 A | | 3/1993 | Difloe | 5/652.1 |
| 5,731,042 A | | 3/1998 | Glende et al. | 427/470 |
| 5,856,249 A | | 1/1999 | Waldrop et al. | 442/184 |
| 5,939,341 A | * | 8/1999 | Brown et al. | 442/351 |
| 6,127,485 A | * | 10/2000 | Klun et al. | 525/199 |

FOREIGN PATENT DOCUMENTS

| | | |
|---|---|---|
| GB | 2 104 446 | 3/1983 |

* cited by examiner

*Primary Examiner*—Terrel Morris
*Assistant Examiner*—John J. Guarriello
(74) *Attorney, Agent, or Firm*—Nixon & Vanderhye

(57) ABSTRACT

A method of making a polypropylene base fabric for outdoor use, and the fabric so produced, results in an outdoor use product (such as a furniture cover) having high mechanical durability, improved hand, excellent color durability, and lower soiling than comparable conventional products. The method is practiced using yarn comprising or consisting of polypropylene, UV inhibitor, and fluorochemical by: weaving the yarn using heavier yarn in the warp direction and finer yarn in the filling direction, or yarns of substantially equal size or denier in the warp and filling directions, to produce a fabric with a face, a center, and a back, with at least 50% (e.g. about 50–70%) of the filling yarn exposed to the fabric face (and for example about 6–10% in the center and about 20–40% in the back); washing the fabric with detergent and water to scour off the spin finish on the yarns; and drying the washed fabric at a temperature below the softening point of polypropylene (e.g. about 270–280° F.) using air flow and tension control (e.g. an air flow of between about 4,000–5,100 cfm, and a tenter frame). The fabric produced has a shear stiffness of comparable to less than 3.0 gf/cm*Degrees, and an overall flexural rigidity of comparable to less than 600, for a fabric having a weight of about 6.5 oz/sq. yd. The fabric typically has a weight between about 6–7 ounces per square yard, and has a warp tear strength, pursuant to ASTM D117, of greater than 90, and a filling tear strength of greater than 26.

10 Claims, 1 Drawing Sheet

POLYPROPYLENE OUTDOOR FABRIC

BACKGROUND AND SUMMARY OF THE INVENTION

Fabrics for outdoor uses have been known for many years, such as for patio furniture covers, covers for other products that are stored outside, and for a wide variety of other uses. Cotton duck and synthetic fiber fabrics, including those made of acrylics and polyolefins (such as polypropylene) have been particularly popular. However some or all of these fabrics have suffered from a number of deficiencies, such as (depending upon the particular prior art cover or other outdoor fabric) lack of color durability, lack of resistance to soiling so that the fabric does not retain a new and fresh appearance for a very long period of time, poor hand, less than desirable water and oil repellancy, and less structural strength than desired.

In most conventional outdoor use fabrics, finer yarn is used in the warp and heavier yarn used in the filling during the weaving process. The traditional thinking is that heavier yarn used in the filling means lower picks per inch need be used to obtain the fabric than with a finer yarn, and thus weaving costs are kept to a minimum. For example a conventional outdoor use woven fabric has a plain weave with finer yarn in the warp and heavier yarn in the filling, and with about 40% of the filling yarns equally exposed to both the back and the face of the fabric, and about 12% coring to the center of the fabric.

According to the present invention a method of making a polypropylene base fabric for outdoor use, and the fabric, and outdoor use product made from the fabric, are provided which have numerous advantages compared to prior art constructions. One of the most significant advantages of the fabric/product according to the invention is enhanced hand. While hand is difficult to measure quanitatively, it is one of the most easily recognized characteristics of a fabric by a consumer. While shear stiffness and flexural rigidity are not exactly equal to hand, the product according to the invention has improved shear stiffness and flexural rigidity, which are indicative of improved hand. The fabric according to the present invention has a shear stiffness of comparable to less than 3.0 gf/cm*Degrees, and an overall flexural rigidity of comparable to less than 600, for a fabric having a weight of about 6.5 oz/sq. yd.

The fabric according to the invention uses yarns comprising or consisting essentially of polypropylene, UV inhibitor for color fastness when exposed to sunlight, and a fluorochemical or fluoropolymer which causes the fabric to be inherently water repellent, and maintains water repellancy after abrasion. Because of the polymer mix utilized, and the controlled weaving, washing and drying conditions utilized in production, products according to the invention are softer and smoother than otherwise obtainable.

That is products according to the present invention have color durability, and resist fading from exposure to at least 500 hours of simulated sunlight. The products have a soft, comfortable soothing and smoother finish than comparable outdoor fabrics. The fabrics of the invention stay dryer than comparable fabrics that are surface treated with a fluorochemical water and oil repellancy treatment. The fabrics of the present invention continue to resist staining after wear abrasion such as with sandpaper. The fabrics of the present invention also tend to clean easily. Dirt can frequently be shaken from these fabrics, which exhibit much lower soiling than comparable fabrics. Finally, the fabrics of the invention dry more quickly than comparable fabrics making them resistant to mildew and tending to stay new and fresh appearing for much longer periods than comparable fabrics intended for outdoor use. However, an antimicrobial material may be added if desired.

Contrary to conventional thinking, the fabrics according to the invention are made with the filling yarns predominantly exposed to the face and with either the heavier yarn used in the warp direction and the finer yarn in the filling direction, or yarns of equal size or denier in the warp and filling directions. Therefore the invention uses a higher picks to warp ratio than comparable fabrics. Since it is the filling that is subjected to finishing processes, and fabrics according to the invention have not only more filling exposed but more filling picks inserted than comparable fabrics, the hand is necessarily superior.

According to one aspect of the present invention a method of making a polypropylene base fabric for outdoor use, using yarn comprising or consisting essentially of polypropylene, UV inhibitor, and a fluorochemical, is provided. The method comprises: (a) Weaving the yarn using heavier yarn in the warp direction and finer yarn in the filling direction, or yarns of substantially equal size or denier in the warp and filling directions, to produce a fabric having a face, a center, and a back, with at least 50% of the filling yarns exposed to the fabric face. (b) Washing the fabric to scour off spin finish on the yarns. And, (c) drying the washed fabric at a temperature below the softening point of polypropylene using air flow and tension control. The method may also comprise (d) making the fabric into an outdoor use product (such as a furniture cover), and (e) using the outdoor use product so that the face of the fabric faces the sun.

In the preferred embodiment, (a) is practiced to provide about 50–70%, preferably about 68–70%, of the filling yarns exposed to the fabric face, and about 6–10%, preferably about 8%, in the center, and about 20–40%, preferably about 22–24%, on the back. Typically (b) is practiced using water and detergent. Also typically (c) is practiced using a tenter frame, and at a temperature of between about 270–280 degrees F., and with an air flow of between about 4000–5100 cfm.

In the practice of the invention, typically (a)–(c) are practiced to produce a fabric having a shear stiffness of comparable to less than 3.0 gf/cm*Degrees, and an overall flexural rigidity of comparable to less than 600, for a fabric having a weight of about 6.5 oz/sq. yd. (a) through (c) are also typically practiced to produce a fabric having a weight between about 6–7 ounces per square yard, and to produce a fabric having a warp tear strength, pursuant to ASTM D117, of greater than 90, and a filling tear strength of greater than 26. That is (a)–(c) are practiced to produce a fabric having hand at least 10% better than if (a) were practiced using finer yarn in the warp and heavier yarn in the weft and about 44% of the filling yarns on each the face and back, and about 12% in the center.

According to another aspect of the present invention an outdoor object cover is made from a fabric produced from the method described above. The invention, according to another aspect, also comprises a woven fabric made of yarns consisting essentially of polypropylene, UV inhibitor, and fluorochemical air textured yarn, heavier yarn in the warp direction and finer yarn in the filling direction, or yarns of equal size or denier in the warp and filling directions, having a face, a center, and a back, with at least 50% of the filling yarns exposed to the fabric face. The woven fabric according to the invention preferably has about 68–70% of the filling yarns exposed to the fabric face, and about 8% in the center, and about 22–24% on the back; has a weight of between about 6–7 oz/sq. yd.; has a warp tear strength, pursuant to ASTM D117, of greater than 90, and a filling tear strength of greater than 26; and has a shear stiffness of comparable to less than 3.0 gf/cm*Degrees, and an overall flexural rigidity of comparable to less than 600, for a fabric having a weight of about 6.5 oz/sq. yd.

It is the primary object of the present invention to provide a highly advantageous outdoor use fabric in a simple, yet effective, manner. This and other objects of the invention will become clear from an inspection of the detailed description of the invention and from the appended claims.

DETAILED DESCRIPTION OF THE DRAWINGS

Figure 1:
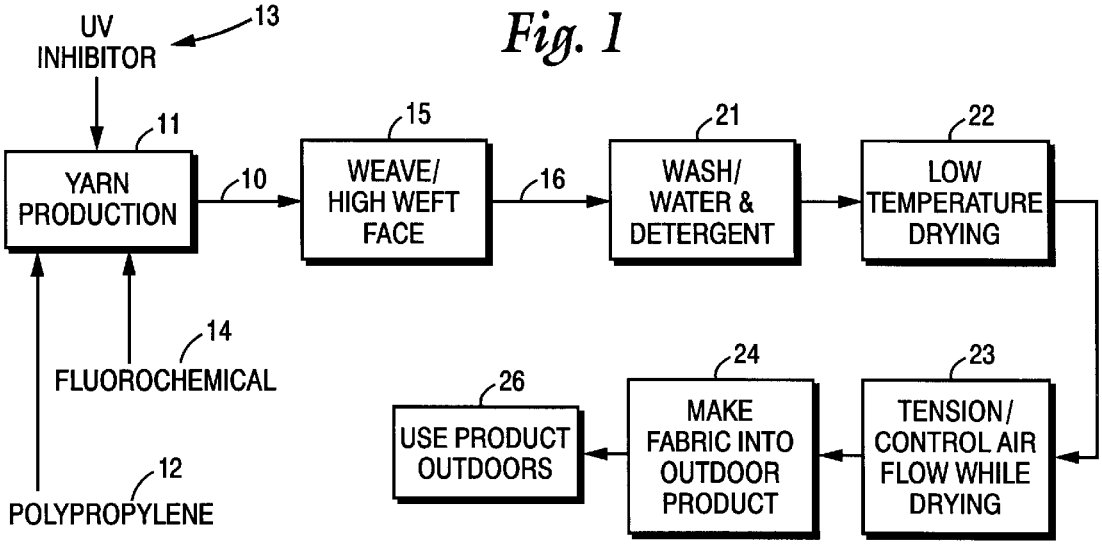
FIG. 1 is a box diagram schematically illustrating the practice of an exemplary method according to the present invention.

FIG. 1 schematically illustrates the practice of an exemplary method according to the present invention. The method starts with yarns, shown schematically at 10 in FIG. 1, that are produced as schematically illustrated at 11. The yarns 10 utilized according to the invention include polypropylene 12, UV inhibitor 13, and fluorochemical 14. The preferred fiber is that prepared by RAM Extrusions, Inc. of Dalton, Ga. comprising or consisting of a polypropylene polymer plus a UV inhibitor and a fluorochemical, preferably PMA FX-1801 supplied by the 3M Company, as well as color additives if desired. RAM mixes the polymer composition with the additives and then extrudes the composition into a continuous filament form. RAM applies a typical spin finish to assist in downstream processing. RAM then air textures the thus formed yarn, to produce the yarns 10 used according to the invention.

Figure 2:
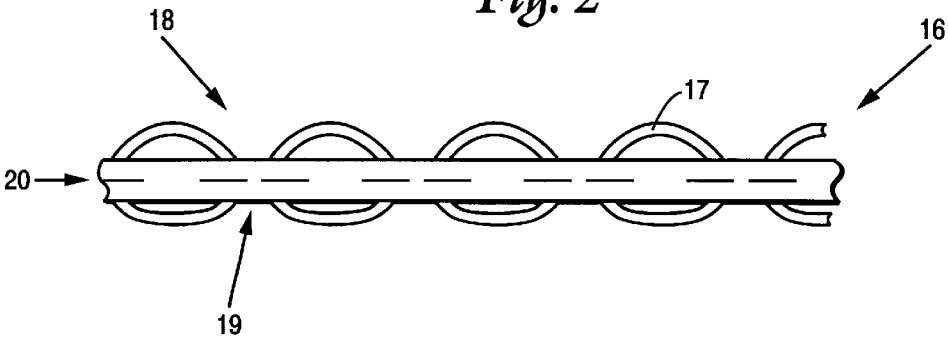
FIG. 2 is a side schematic view of an outdoor use fabric produced according to the present invention.

The advantageous yarns 10 are woven, as schematically illustrated at 15 in FIG. 1, to provide a high weft face. That is weaving step 15 is practiced so that the fabric 16 (see FIG. 2) produced by the weaving stage 15 has no less than 12 harness dobbies [a type of loom harness control] in which the filling yarns 17 are primarily exposed to the face 18, with less filling yarns 17 exposed to the back 19, or coring to the center 20. The preferred denier range for the warp yarn is about 300 to 800, and about half that (e.g. about 150–400) for the filling yarn. For example, stage 15 is practiced using a yarn 10, e.g. 650 denier, in the warp direction, and a yarn 10, e.g. 325 denier, in the filing direction, or by using about 325 denier in both the warp and filling directions. While stage 15 is practiced so that at least 50% of the filling yarns are predominantly exposed to the face 18 of the fabric 16, preferably stage 15 is practiced so that between about 50–70%, most preferably about 68–70%, of the filling yarns 17 are exposed to the face 18, and between about 20–40%, most preferably about 22–24%, to the back 19, with only about 6–10%, most preferably about 8%, coring to the center 20. Stage 15 is also preferably practiced so that the fabric 16 has a weight between about 6–7 ounces per square yard, e.g. about 6.5 ounces per square yard, although heavier or lighter fabrics can be produced.

After weaving at 15, the fabric 16 is washed, as indicated schematically at 21 in FIG. 1, to scour off the spin finish on the yarns 10 which was applied during the production stage 11. The washing stage 21 preferably is practiced utilizing water and detergent, and at a temperature and conditions which effectively remove the vast majority of the spin finish. Removing the spin finish enhances the water and all the oil repellancy of the resultant woven fabric 16. For example stage 21 may be practiced using a Kuster washer equipped with automatic tension control on steam/dwell chambers in multi-pass wash boxes, allowing open width, wrinkle free, controlled tension processing.

After stage 21 the fabric 16 is dried, as indicated schematically at 22, using tension and air control, as indicated schematically 23. Typically the stages 22, 23 are practiced together, for example, in a conventional tenter frame with a low profile housing, circulated hot air, cold water exit cooling, and computerized process control including automatic tension control from entry to exit of the tenter frame.

Processing in stages 22, 23 is typically practiced to dry at low temperature, that is keeping the tenter frame temperature below the softening point of polypropylene, which is about 290°–300° F. The desired temperature range for frame finishing of polypropylene is between about 270–280° F. Width-wise tension is preferably controlled by the fabric construction and the tenter rail settings. Length-wise tension is preferably controlled by the use of overfeed rollers and the frame tension control system utilizing a combination of sonic, infrared and load cells. Air flow is preferably controlled by circulating fans with inverters to control motor load and rpm, and the desired air flow range is between about 4000–5100 cfm (e.g. about 4060–5075 cfm).

Figure 3:
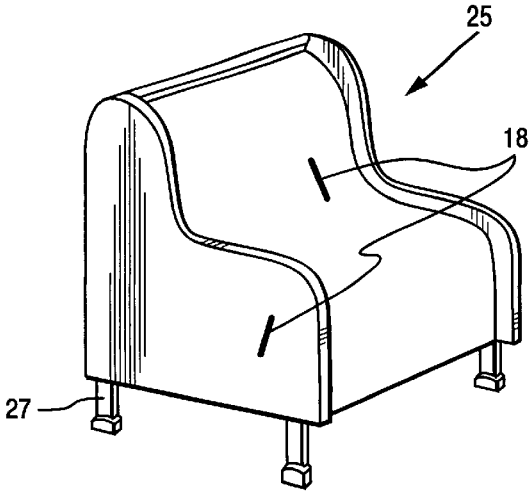
FIG. 3 is a schematic perspective showing an outdoor use product made from the fabric of FIG. 2 serving as an outdoor furniture cover.

As indicated at stage 24 in FIG. 1, the fabric exiting the tenter frame is made into an outdoor product of any conventional construction, such as the furniture cover illustrated schematically at 25 in FIG. 3. Then, as illustrated schematically at 26 in FIG. 1, the product 25 is used outdoors in a functional manner. For example as illustrated in FIG. 3 the product 25 is illustrated covering an outdoor chair 27, or for covering a snowmobile, car, woodpile, bicycle, or any other outside object. The stage 24 is practiced so that the front face 18 of the fabric 16 from which the product 25 is made faces the sun, as schematically illustrated in FIG. 3.

The fabric 16, and product 25, according to the present invention have high color durability. Color durability is measured by light fastness, and the fabric/products 16, 25 according to the present invention resist fading from exposure to at least 1000 hours of simulated sunlight, typically over 1,000 hours. The fabric/products 16, 25 according to the invention also have improved pilling. Soil resistance is also excellent, as measured by oil and water drop (alcohol) repellancy.

The fabric 16, and products 25, according to the present invention have a shear stiffness of comparable to less than 3.0 gf/cm*Degrees, and an overall flexural rigidity of comparable to less than 600, for a fabric having a weight of about 6.5 oz/sq. yd. The fabric 16 and products 25 also have a warp tear strength, pursuant to ASTM D117, of greater than 90, and a filling tear strength of greater than 26. The fabric 16 and products 25 according to the invention also have a hand at least 10% better than if stage 15 were practiced using finer yarn in the warp and heavier yarn in the weft and about 40% of the filling yarn on each of the face and back and about 12% on the center (that is a conventional construction).

The fabric 16 according to the present invention has been tested compared to commercially available 100% acrylic and 100% polypropylene commercial products. A summary of the results of one such test are provided in Table 1 below.

In the Table, Sample #1 is a 100% acrylic commercial product with post-fabric production fluorochemical treatment, Sample #2 a 100% polypropylene commercial product, and Sample #3 is a product produced according to the present invention, made from the RAM yarn described above consisting essentially of polypropylene with a UV inhibitor and a fluorochemical that is air texture by weaving so that heavier yarn is in the warp direction and finer yarn in the filling direction with about 69% of the filling yarn exposed to the face, about 8% in the center, and about 23% on the back, washed with water and detergent to remove substantially all of the spin finish on the yarns, and dried in a conventional tenter range at a temperature of about 275° F. with an air flow of about 4500 cfm.

TABLE I

| Property | Sample #1 | Sample #2 | Sample #3 |
|---|---|---|---|
| Tensile | | | |
| LT (–) | 0.78 | 0.78 | 0.78 |
| WT (gf* cm/cm$^2$) | 3.55 | 5.97 | 7.40 |
| RT (%) | 55.42 | 54.02 | 44.94 |
| EMT (%) | 1.81 | 3.07 | 3.77 |
| Shear Stiffness | | | |
| G (gf/cm * Degree) | 3.16 | 5.61 | 2.10 |
| 2HG (gf/cm) | 1.80 | 11.82 | 4.14 |
| 2HG5 (gf/cm) | 15.22 | >20.00 | 11.60 |
| Bending Rigidity | | | |
| B (gf* cm$^2$/cm) | too stiff | too stiff | too stiff |
| 2HB (gf* cm/cm) | too stiff | too stiff | too stiff |
| Surface | | | |
| MIU (–) | .022 | 0.23 | 0.27 |
| MMD (–) | 0.23 | 0.32 | 0.30 |
| SMD (micron | 14.74 | 18.08 | 9.84 |
| Compression | | | |
| LC (–) | 0.03 | 0.03 | 0.03 |
| WC (gf* cm/cm$^2$) | 0.31 | 0.13 | 0.20 |
| RC (%) | 51.04 | 49.92 | 53.46 |
| EMC (%) | 40.46 | 25.60 | 26.63 |
| Thickness (mm) | 1.01 | 0.78 | 0.88 |
| Weight (oz/yd$^2$) | 7.79 | 6.57 | 6.56 |
| Flexural Rigidity | | | |
| Overall Rigidity | 843.47 | 738.99 | 469.05 |
| Length of Overhang | | | |
| Warp (cm) | 8/03 | 7.25 | 8.75 |
| Filling (cm) | 6.83 | 7.48 | 4.78 |

When evaluating the results in Table 1 please note that a higher EMT value indicates greater extensibility, or that the sample possesses a higher degree of stretchability. A higher G value indicates greater stiffness to the shearing motion (lower G is softer/more pliable). A higher B value indicates greater bending rigidity. A higher SMD value indicates a rougher fabric surface. A higher RC value means a higher percent recovery from being compressed.

During the testing, as exhibited by the summary of results of Table 1, the materials were too stiff to bend on a KES bending tester, therefore the reported stiffness results were obtained from the cantilever test.

Sample #1, which is heavier and thicker, is more compressible (higher EMC, percent thickness with maximum force compared to initial thickness with no force in compression test). It is least extensible in the tensile test (lowest EMT). It has highest flexural rigidity, which may be expected since it is thicker than the other samples.

Sample #3 is smoothest (lowest SMD) but has a little higher surface friction (higher MIU) which may be associated with the greater surface contact of friction probe with a smother surface sample. it is most shearable (lowest G), and has a little edge on other samples in elongation/stretch in the tensile test. It is also judged to be most bendable (lowest flexural rigidity).

Sample #2 does not appear to have any outstanding attributes in mechanical hand properties. It has a much higher degree of shearing stiffness (highest G) than the other samples. It is about twice as stiff to bending as the others.

The fabric 16 was also tested, again with respect to the same two commercial fabrics, as indicated in Table 2 below.

TABLE 2

| | | Sample #1 | Sample #2 | Sample #3 |
|---|---|---|---|---|
| Tear Strength | warp | 70 | 75.2 | 110.8 |
| ASTM D117 | fill | 23 | 24 | 31.4 |
| (Trapezoidal) | | | | |
| Tensile Strength | warp | 245 | 257 | 315 |
| ASTM D5034 | fill | 107 | 186 | 115 |
| Wyzenbeek Abrasion | | heavy | heavy | slight |
| Resistance | | frosting | frosting | frosting |
| ASTM D4157 (Wire) | | no fiber | no fiber | no fiber |
| | | breakage | breakage | breakage |
| Spray Test | orig | 50 | 0 | 100 |
| AATCC 22 | 1x | 50 | 70 | 100 |
| | 3x | 50 | 70 | 100 |
| Roughing and Pilling | | 3 | 4 | 4 |
| ASTM D3512 - modified | | | | |
| Seam Slippage | w/f | 40 | 43 | 51 |
| ASTM D434 | f/w | 26 | 51 | 35 |
| Brush Pilling | | 5 | 3.5 | 5 |
| ASTM D3511 | | | | |
| 120° F. Wash Shrinkage | warp | –2.80T | –2.13% | –2.60% |
| AATCC 135 (1, IV, B) | fill | –0.33% | –0.67% | –2.40% |
| Oil Repellancy | orig | 4 | 0 | 3 |
| | 1x | 1 | 0 | 1 |
| | 3x | 0 | 1 | 0 |
| Water Drop | orig | 7 | 0 | 6 |
| | 1x | 3 | 0 | 3 |
| | 3x | 3 | 2 | 5 |
| Oil after Abrasion | orig | 0 | 0 | 3 |
| | 1x | 2 | 0 | 0 |
| | 3x | 0 | 0 | 0 |
| Water after Abrasion | orig | 0 | 0 | 6 |
| | 1x | 3 | 1 | 3 |
| | 3x | 1 | 1 | 4 |
| Resistance to Fungi | | light | traces | none |
| ASTM G-21 | | (10–30%) | (<10%) | |

All seam slippage values are for thread breakages (no slippage). The resistance to fungi was tested on slightly different (although not significantly different) versions of the Sample #3 fabric according to the invention.

It will thus be seen that the fabric 16 according to the invention has enhanced properties desirable for outdoor product 25 use, including lower shear stiffness, lower overall rigidity, and higher tear and tensile strength, as well as having excellent color durability, resistance to staining after wear abrasion such as with sandpaper, easy cleanability, and faster drying, making the product 25 more resistant to mildew and tending to stay new and fresh appearing for longer periods of time.

In the above description, where ranges are recited it is to be understood that the invention encompasses all narrower ranges within the broad range recited. For example the range of 20–40% includes 21–39%, 26–40%, 29–33%, and all other narrower ranges within the broad range.

While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of making a polypropylene base fabric for outdoor use, using polypropylene, UV inhibitor, and fluorochemical air textured yarn, comprising:

(a) weaving the yarn using heavier yarn in the warp direction and finer yarn in the filling direction, or yarns of substantially equal size or denier in the warp and filling directions, to produce a fabric having a face, a center, and a back, with at least 50% and about 50–70% of the filling yarns exposed to the fabric face, about 6–10% in the center, and about 20–40% on the back;

(b) washing the fabric to scour off spin finish on the yarns;

(c) drying the washed fabric at a temperature below the softening point of polypropylene using air flow and tension control;

(d) making the fabric into an outdoor use product; and (e) using the outdoor use product so that the face of the fabric faces the sun.

2. A method as recited in claim 1 wherein (b) is practiced using water and detergent.

3. A method as recited in claim 2 wherein (c) is practiced using a tenter frame, and at a temperature of between about 270–280 degrees F., and with an air flow of between about 4000–5100 cfm.

4. A method as recited in claim 1 wherein (a)–(c) are practiced to produce a fabric having a weight of between about 6–7 oz/sq. yd.

5. A method as recited in claim 1 wherein (a)–(c) are practiced to produce a fabric having a warp tear strength, pursuant to ASTM D117, of greater than 90, and a filling tear strength of greater than 26.

6. A method as recited in claim 1 wherein (a)–(c) are practiced to produce a fabric having hand at least 10% better than if (a) were practiced using finer yarn in the warp and heavier yarn in the weft and about 44% of the filling yarns on each the face and back, and about 12% in the center.

7. An outdoor object cover made from a fabric produced according to the method of claim 1.

8. An outdoor object cover as recited in claim 7 having about 68–70% of the filling yarns exposed to the fabric face, and about 8% in the center, and about 22–24% on the back.

9. A method of making a polypropylene base fabric for outdoor use, using polypropylene, UV inhibitor, and fluorochemical air textured yarn, comprising:

(a) weaving the yarn using heavier yarn in the warp direction and finer yarn in the filling direction, or yarns of substantially equal size or denier in the warp and filling directions, to produce a fabric having a face, a center, and a back, with at least 50% and about 50–70% of the filling yarns exposed to the fabric face, about 6–10% in the center, and about 20–40% on the back;

(b) washing the fabric to scour off spin finish on the yarns;

(c) drying the washed fabric at a temperature below the softening point of polypropylene using air flow and tension control; and wherein (a)–(c) are practiced to produce a fabric having a shear stiffness of comparable to less than 3.0 gf/cm*Degrees, and an overall flexural rigidity of comparable to less than 600, for a fabric having a weight of about 6.5 oz/sq. yd.

10. A method as recited in claim 9 wherein (a)–(c) are practiced to produce a fabric having a weight of between about 6–7 oz/sq. yd.

* * * * *